US010212999B2

(12) United States Patent
Clarke et al.

(10) Patent No.: US 10,212,999 B2
(45) Date of Patent: Feb. 26, 2019

(54) LUGGAGE APPARATUS

(71) Applicants: Tamar Clarke, Ascot (GB); Tom Clarke, Ascot (GB)

(72) Inventors: Tamar Clarke, Ascot (GB); Tom Clarke, Ascot (GB)

( * ) Notice: Subject to any disclaimer, the term of this patent is extended or adjusted under 35 U.S.C. 154(b) by 153 days.

(21) Appl. No.: 14/387,525

(22) PCT Filed: Mar. 28, 2013

(86) PCT No.: PCT/GB2013/000136
§ 371 (c)(1),
(2) Date: Sep. 23, 2014

(87) PCT Pub. No.: WO2013/144545
PCT Pub. Date: Oct. 3, 2013

(65) Prior Publication Data

US 2015/0075933 A1 Mar. 19, 2015

(30) Foreign Application Priority Data

Mar. 28, 2012 (GB) ..... 1205514

(51) Int. Cl.
*A45C 9/00* (2006.01)
*A45C 13/26* (2006.01)
(Continued)

(52) U.S. Cl.
CPC ..... *A45C 9/00* (2013.01); *A45C 5/14* (2013.01); *A45C 5/146* (2013.01); *A45C 13/26* (2013.01);
(Continued)

(58) Field of Classification Search
CPC .. A45C 9/00; A45C 5/14; A45C 5/146; A45C 13/26; A45C 13/28; A45C 2009/002; A45C 2009/005; A45C 2013/267
See application file for complete search history.

(56) References Cited

U.S. PATENT DOCUMENTS 751,448 A * 2/1904 Barschow ..... B62B 7/08 280/642
1,076,087 A * 10/1913 Wannenwetsch ..... 280/37
(Continued)

FOREIGN PATENT DOCUMENTS

EP 0422759 A1 4/1991
EP 1402797 A1 3/2004
(Continued)

OTHER PUBLICATIONS

International Search Report issued for International Patent Application No. PCT/GB2013/000136, dated Jul. 9, 2013. 4 pages.

*Primary Examiner* — Tri Mai
(74) *Attorney, Agent, or Firm* — Perkins Coie LLP

(57) ABSTRACT

A luggage apparatus is described. The luggage apparatus comprises an apparatus body having a moveable portion and a fixed portion, the moveable portion being movable with respect to the fixed portion between a deployed position and a stowed position. In the deployed position, a moveable portion surface and a fixed portion surface are arranged to define a seat for a child and in the stowed position, the moveable and fixed portion surfaces are substantially contained within the luggage apparatus body.

4 Claims, 3 Drawing Sheets

(51) Int. Cl.
*A45C 13/28* (2006.01)
*A45C 5/14* (2006.01)

(52) U.S. Cl.
CPC ..... *A45C 13/28* (2013.01); *A45C 2009/002* (2013.01); *A45C 2009/005* (2013.01); *A45C 2013/267* (2013.01)

(56) References Cited

U.S. PATENT DOCUMENTS 1,409,312 A * 3/1922 Pippin ..... B62B 7/02 280/37
1,503,714 A * 8/1924 Schnipper ..... B62B 7/02 280/37
2,068,295 A * 1/1937 Kramer ..... B62B 7/02 280/37
2,170,227 A * 8/1939 Weber ..... B62B 7/10 280/37
2,221,111 A * 11/1940 Sayles ..... B62B 7/02 280/37
2,549,958 A * 4/1951 Bosk ..... B62B 7/10 280/37
2,560,708 A * 7/1951 Titus ..... A47D 1/00 297/134
2,693,846 A * 11/1954 Luttio ..... A47C 13/00 297/105
3,679,223 A * 7/1972 Sakal ..... B60N 2/2833 280/37
4,974,870 A * 12/1990 Jarke ..... A47C 4/04 280/643
5,899,467 A * 5/1999 Henkel ..... A45C 5/14 190/1
5,988,657 A 11/1999 Henkel
6,672,659 B1 * 1/2004 Melohn ..... A63H 3/52 297/118
2007/0007801 A1 1/2007 Bishop
2007/0089952 A1 4/2007 Herbst et al.
2007/0289480 A1 12/2007 Yang et al.
2008/0164667 A1 7/2008 Fegler et al.
2009/0289480 A1 11/2009 McFarland et al.
2010/0175960 A1 7/2010 Moskowitz et al.

FOREIGN PATENT DOCUMENTS

FR 2904921 A1 2/2008
FR 2933579 A1 1/2010
WO WO-99/60882 A1 12/1999

* cited by examiner

LUGGAGE APPARATUS

RELATED APPLICATIONS

This application is a 35 U.S.C. 371 National Stage Application of PCT/GB20132/000136, filed Mar. 28, 2013, which claims priority to Great Britain Patent Application No. 1205514.1, filed Mar. 28, 2012, each of which is incorporated herein by reference.

FIELD

The present disclosure relates to a luggage apparatus, particularly luggage apparatus suitable for use as cabin baggage.

BACKGROUND

The increase in the popularity of air travel experienced in recent years has required the introduction of more stringent security procedures for passengers at airports and the standardisation of rules concerning what may or may not be permitted within an aircraft cabin.

Travelling with young children makes complying with the rules and changes, described above, more demanding. A parent of a young child will generally prefer to have the child's pram with them at all times. However it is awkward to get the pram through security as the pram may have to be emptied and collapsed to be x-rayed, or if the pram does not pass through the x-ray, it will have to be visually inspected, causing delay.

Usually, once the family reach the aircraft doors, the pram is taken away by airport staff and stored in the hold. This is time-consuming for the airport authorities and frustrating for the parent of the child as, when they arrived at theft destination, they may not be reunited with their pram until they reach the baggage hall.

SUMMARY

According to some embodiments, there is provided a luggage apparatus, the apparatus comprising:

an apparatus body having a moveable portion and a fixed portion, the moveable portion being movable with respect to the fixed portion between a deployed position in which a moveable portion surface and a fixed portion surface are arranged to define a seat for a child, and a stowed position in which the moveable and fixed portion surfaces are substantially contained within the apparatus body.

In at least one embodiment providing a child seat which, in the stowed position, can be fully contained within the apparatus body has distinct advantages. For example, some forms of luggage, such as cabin baggage, are subject to vigorously enforced size restrictions. The luggage apparatus described herein is suitable for use as a pram when the luggage apparatus is in the deployed position, allowing a child to be transported around the airport and onto the plane, and a suitcase in the stowed position. The apparatus can be configured such that, in the stowed position, it complies with the cabin baggage size restrictions. Such an arrangement permits the apparatus to be taken onto the aircraft, doing away with the need for a separate pram requiring stowing in the aircraft hold.

In some embodiments, the luggage apparatus is a suitcase. Particularly, the luggage apparatus may be a cabin baggage sized suitcase. Airline companies provide information on the acceptable size of cabin baggage, most airlines adhering to a standard size. Manufacturing the luggage apparatus described herein to the standard size permits the apparatus to be treated as cabin baggage and therefore providing the user with a "pram" which the user can take onto the plane.

The moveable portion may comprise an at least one storage compartment.

Additionally, or alternatively, the fixed portion may comprise an at least one storage compartment.

In some embodiments, both the moveable and fixed portions comprise an at least one storage compartment. The at least one storage compartment may be substantially rigid. Alternatively or additionally the at least one storage compartment may comprise a resilient material. In such an arrangement, the storage provided by the apparatus is maximised increasing utility of the apparatus. Furthermore, unlike a conventional travel pram, the storage compartments do not need to be emptied to allow the "pram" to collapse. The movable portion is simply folded back into the stowed position.

In some embodiments, the/each movable and/or fixed portion storage compartment has at least two access points. One of the access points may be on a side of the apparatus. Providing multiple access points for each storage compartment allows the contents of the storage compartment to be accessed from different angles and particularly when the moveable portion is deployed. In such positions, the front and top surfaces of the apparatus may be hidden by the deployment of the moveable portion and/or a child sitting in the apparatus.

The moveable portion may pivot with respect to the fixed portion.

The moveable portion may pivot with respect to the fixed portion around a hinge.

In moving from the stowed position to the deployed position, the moveable portion surface may pivot away from the fixed portion surface.

The moveable portion may be connected with the fixed portion along an edge.

The edge may extend the full width of the child's seat.

The edge may comprise a hinge, particularly, the hinge maybe a living hinge. A living hinge can be utilised to eliminate pinch points.

In the stowed position, the moveable and fixed portion surfaces may be substantially opposed.

In some embodiments, in the stowed position, the moveable and fixed portion surfaces are at least partially in contact. Having close contact between the surfaces reduces the amount of space the "pram" part of the luggage apparatus takes up, in some embodiments, increasing the availability of space.

In the stowed position, the movable and fixed portions are sealably connected to prevent ingress of water between the movable portion surface and fixed portion surface.

The movable portion may define a section of an apparatus external surface.

In some embodiments, an apparatus body external surface is substantially defined by the movable portion and the fixed portion. Such an arrangement allows for quick deployment as the movable portion does not need to be first removed from, for example, inside the apparatus.

In some embodiments, the movable portion is deployed by applying a pull force to an external surface of the apparatus body.

The movable portion may be releasably fixed in the stowed position.

The movable portion may be releasably fixed in the stowed position by an interference fit, a clip, a snap fit or by any suitable method.

The fixed portion surface may be adapted to receive a child's bottom.

The fixed portion surface may be substantially contained within the apparatus body in both the stowed and deployed positions.

The fixed portion may comprise extending elements adapted, in the deployed position, to provide sides for the child seat. The extending elements may act as armrests. In the stowed position, the movable portion may be contained within the extending elements. Providing extending elements which can protect the movable portion in the stowed position, allows for a less rigid construction to be utilised for the movable portion making it easier to manipulate between the stowed and deployed positions.

The apparatus may comprise a restraining member.

The restraining member may, in the deployed position and in use with a child, prevent a child from sliding off or climbing out of the seat.

The restraining member may be a harness and/or a barrier device.

Where the restraining member is a barrier device, the barrier may, in the deployed position, be located adjacent an interface between the moveable and fixed portions. In such an embodiment, the barrier may be adapted to prevent, in use, the child sliding off the fixed portion surface. The barrier may be positionable between the child's legs. In such an embodiment, the barrier may be substantially perpendicular to the fixed surface.

The barrier may define a "T" shape. Such an arrangement provides a horizontal bar, in use, for a child to grip onto.

The barrier may be movable between a stowed position and a deployed position. The barrier may be pivotally movable between the stowed and deployed positions. In the stowed position, the barrier may lie between the moveable portion surface and the fixed portion surface. One or other of the surfaces may define a recess adapted to receive the barrier.

In alternative embodiments, the harrier may be adapted to be received within one or other of the moveable or fixed body portions.

The moveable portion may comprise a first and a second section. The first section may be movable with respect to the second section. The first section may be pivotable with respect to the second section. The first section may be connected to the second section by means of a hinge.

The moveable portion surface may be adapted, in use, to support the child's legs.

The moveable portion may include a support member adapted to support, in use, a child's feet. The support member may be a foot rest. Providing footrest gives a child using the seat something to press against which is beneficial for the child's development. The support member may be pivotally mounted to the moveable portion.

The apparatus may further comprise a backrest. A backrest is provided to support a child, particularly when the apparatus is inclined. The backrest may be movable with respect to the apparatus body. The backrest may be movable such that in the stowed position, the backrest is contained within the apparatus body and in the deployed position the backrest extends from the apparatus body. In the deployed position, the backrest may provide a surface which is an extension of the fixed portion surface.

The luggage apparatus may comprise a handle to allow the apparatus to be pushed or pulled around. The handle is of the conventional type in which the handle is stored within the apparatus body when not in use and may be pulled out when the luggage apparatus is to be moved. The handle may provide a support for the backrest in the deployed position.

The luggage apparatus may comprise wheels. At least one of the wheels may also be deployable. There may be two fixed wheels and at least one deployable wheel. The at least one deployable may be steerable. The at least one deployable wheel may be movable with respect to the apparatus body from a stored position to a usable position. In the usable position, the at least one deployable wheel may be arranged such that the luggage apparatus can be tilted to an angle and remain stable. The angle may be adjustable. In use, the user utilises the at least one deployable wheel to tilt the apparatus to an angle which allows the apparatus to be pushed around like a pram. The at least one deployable wheel keeps the apparatus stable.

When the at least one deployable wheel is stored, intended for when the luggage apparatus is in the stowed position, the luggage apparatus can be wheeled around like a conventional cabin bag on the fixed wheels.

According to some embodiments described herein, there is provided a method of configuring a luggage apparatus, the method comprising the steps of:

providing a luggage apparatus with a fixed portion and movable portion, moving the movable portion from the stowed position in which the luggage apparatus is substantially configured like a suitcase, to the deployed position in which the luggage apparatus defines a child seat and the apparatus is substantially configured like a pram.

It will be understood that preferred features of the apparatus described herein may be equally applicable to the methods described herein and have not been repeated for brevity.

BRIEF DESCRIPTION OF THE DRAWINGS

Various embodiments disclosed herein will now be described with reference to the accompanying drawings in which.

DETAILED DESCRIPTION OF THE DRAWINGS

Figure 2:
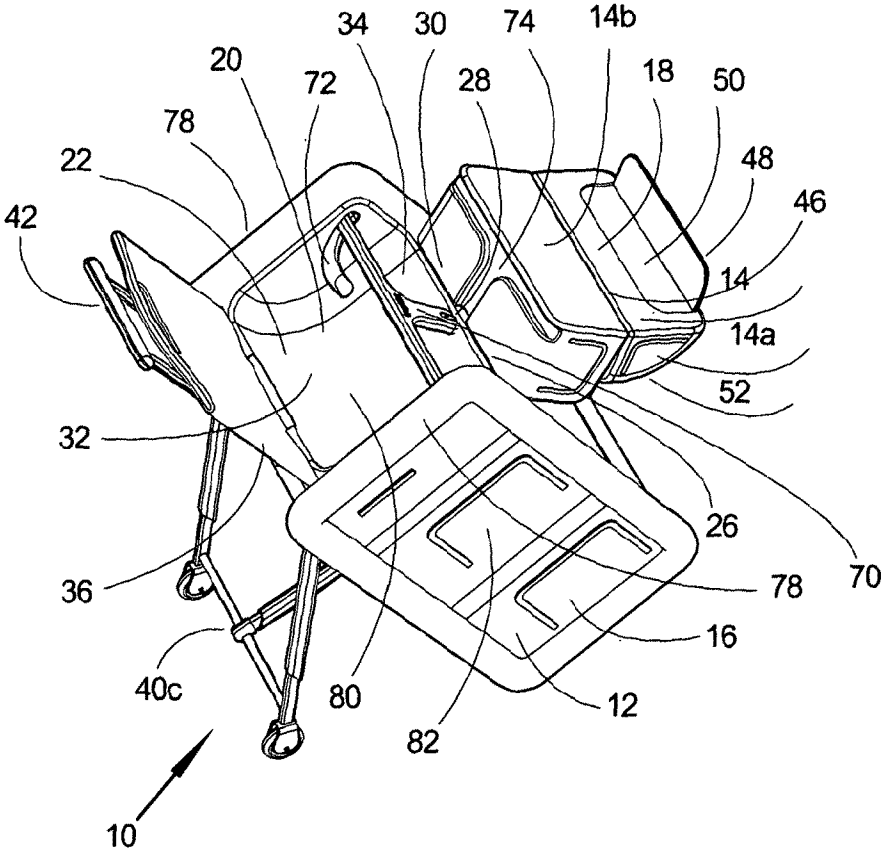
FIG. 2 is a perspective view of the luggage apparatus of FIG. 1 shown in a deployed position.
Figure 1:
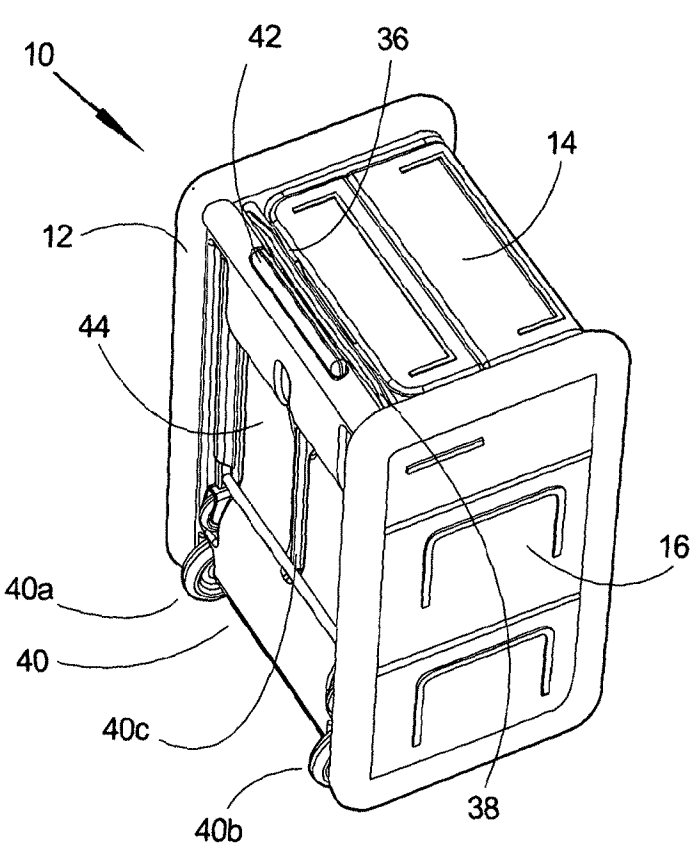
FIG. 1 is a perspective view of a luggage apparatus shown in a stowed position according to a moveable embodiment described herein.

Reference is firstly made to FIGS. 1 and 2, perspective views of a luggage apparatus, generally indicated by reference numeral 10, according to various embodiments disclosed herein.

The luggage apparatus 10 comprises an apparatus body 12 having a moveable portion 14 and fixed portion 16, the moveable portion 14 being movable with respect to the fixed portion 16 between a deployed position (FIG. 2), in which a moveable portion surface 18 and a fixed portion surface 20 are arranged to define a seat 22 for a child, and a stowed position (FIG. 1) in which the moveable and fixed portion surfaces 18, 20 are substantially contained within the apparatus 10.

The moveable portion 14 is connected to the fixed portion 16 by a hinge 26 extending the length of a moveable portion edge 28 and a fixed portion edge 30. The hinge 26 allows the moveable portion 14 to pivot with respect to the fixed portion 16 from the stowed position shown in FIG. 1 to the deployed position shown in FIG. 2.

The fixed portion surface 20 is shaped to receive a child's bottom and includes a curved surface section 32, providing a gradual transition through 90° from a fixed portion surface flat section 34 to an apparatus backrest 36. As can be seen, particularly from FIG. 1, the apparatus backrest 36 when not in use is stored in a recess 38 defined by the apparatus body 12, and in the deployed position shown in FIG. 2, is supported and reinforced by an apparatus handle 42, provided for pulling or pushing the luggage apparatus 10. Referring to FIG. 2, it will also be noted that the apparatus backrest 36 is curved across its width to provide a comfortable surface for the child to lean against, in use.

The fixed portion 16 further comprises extendable sections 78 which have a number of purposes. The extendable sections 78 act as armrests for a child using the seat 22, extendable sections 78 assist in securing the child within the seat 22, and, together with the fixed portion surface 20, the extendable sections 78 define a recess 80 into which the movable portion 14 may be wholly contained in the stowed position. The extendable sections 78 form part of the side 82 of the fixed portion 16 which, in turn, defines the side profile of the luggage apparatus 10 when it is in the stowed position, and as usable as a suitcase.

The apparatus 10 further comprises a barrier 70 which, in the deployed position, sits across and between the child's legs to resist, in use, the child climbing out of the seat 22 or sliding off the apparatus 10. The barrier 70 is pivotable from the position shown in FIG. 2 to a position in which it lies against the fixed portion surface flat section 34. Barrier guide slots 72 are provided in the fixed portion extendable sections 78 to guide the barrier 70 as it pivots. When the barrier 70 lies against the fixed portion surface flat section 34, the movable portion 14 can be moved to the stowed position, the barrier 70 been received within a recess 74 defined by the movable portion surface 18.

The apparatus further comprises a set of wheels 40 which can be used to facilitate movement of the luggage apparatus 10 either n the stowed position shown in FIG. 1 or the deployed position shown in FIG. 2. The wheels 40 comprise first and second fixed wheels 40*a*, 40*b* and a pair of stability wheels 40*c*. The stability wheels 40*c* are steerable and can be stored against the back surface 44 of the apparatus body 12 (FIG. 1) or be extended from the back surface 44 (FIG. 2) to provide stability for the luggage apparatus 10 in an inclined orientation which a child using the seat 22 may find more comfortable than the upright orientation of FIG. 1. The stability wheels 40*c* are however usable in both the stowed position or the deployed position of the movable portion 14. They are not restricted to use only in the deployed position of the movable portion 14.

The moveable portion 14 comprises a first moveable portion section 14*a* and a second moveable portion section 14*b*. The first and second moveable portion sections being connected by a second hinge 46.

The first movable portion section 14*a* also includes a footrest 48 which is hingedly connected to the first movable portion section 14*a* and can be lifted out of a footrest recess 50 when the movable portion 14 is deployed to provide a footrest for a child.

The first movable portion section 14*a* defines a curved surface 52 which in the stowed position, is engaged with the curved surface section 32 of the fixed portion surface 20. This arrangement provides a usable movable portion surface 18 which is longer than the fixed portion surface 20 to provide a greater support area for the infant's legs.

The deployment of the movable portion 14 will now be described with reference to FIG. 3, comprising FIGS. 3*a* to 3*c*, a series of side views of the apparatus 10 of FIG. 1 showing the deployment of the movable portion 14.

Figures 3, 3A, 3B, 3C:
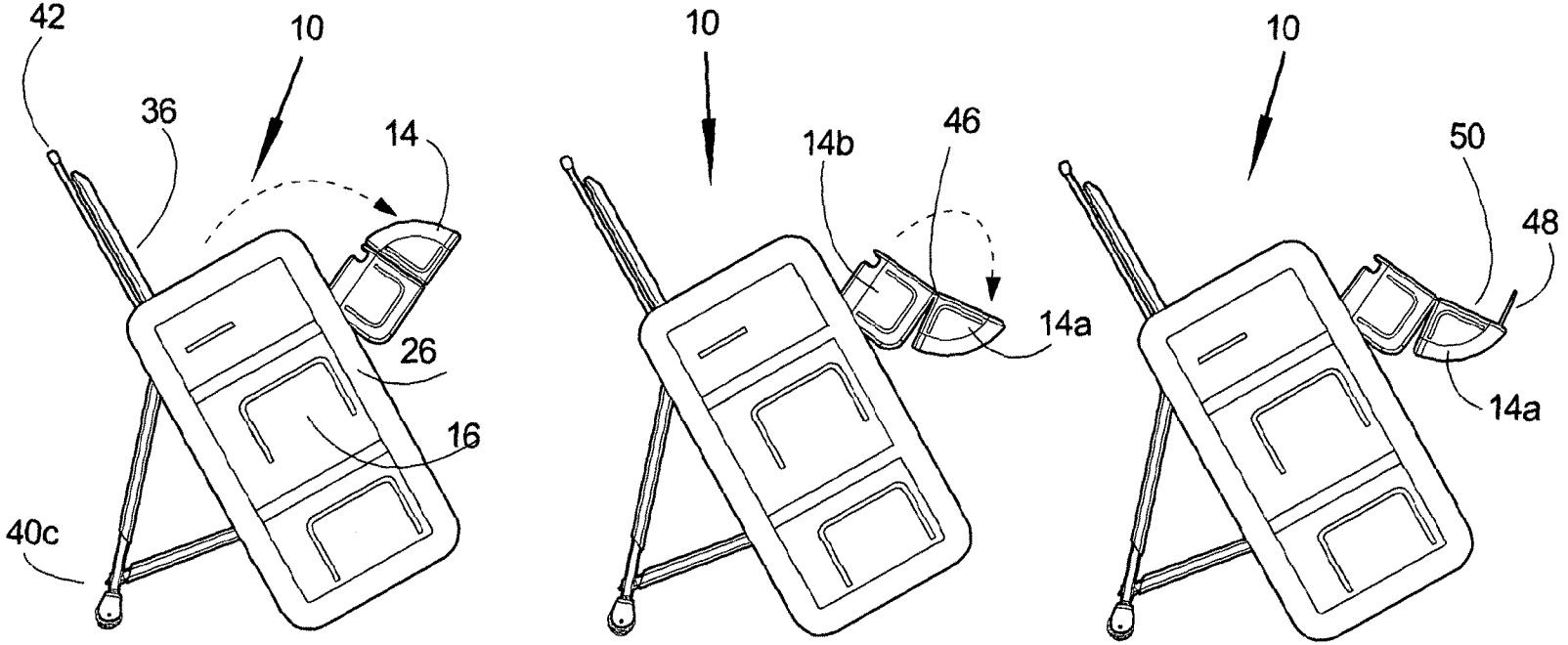
FIG. 3, comprising
FIGS. 3*a* to 3*c*, is a series of side views of the apparatus of FIG. 1 showing the deployment of the movable portion

In FIG. 3*a*, the stability wheels 40*c*, the backrest 36 and the apparatus handle 42 have been deployed. The movable portion 14 is pivoted around the first hinge 26 by the application of a pull force to a knob 90 on the upper surface of the movable portion 14 (most clearly visible on FIG. 1).

Once the movable portion 14 is in the position shown in FIG. 3*a*, the first movable portion section 14*a* is pivoted away from the second movable portion section 14*b* around the second hinge 46 to the position shown in FIG. 3*b*.

Finally, referring to FIG. 3*c*, the footrest 48 is pivoted out of the footrest recess 50 to complete the deployment of the movable portion 14 and convert the luggage apparatus 10 from a "suitcase" shown in FIG. 1 to a "pram" shown in FIG. 2.

Figures 4, 5, 6:
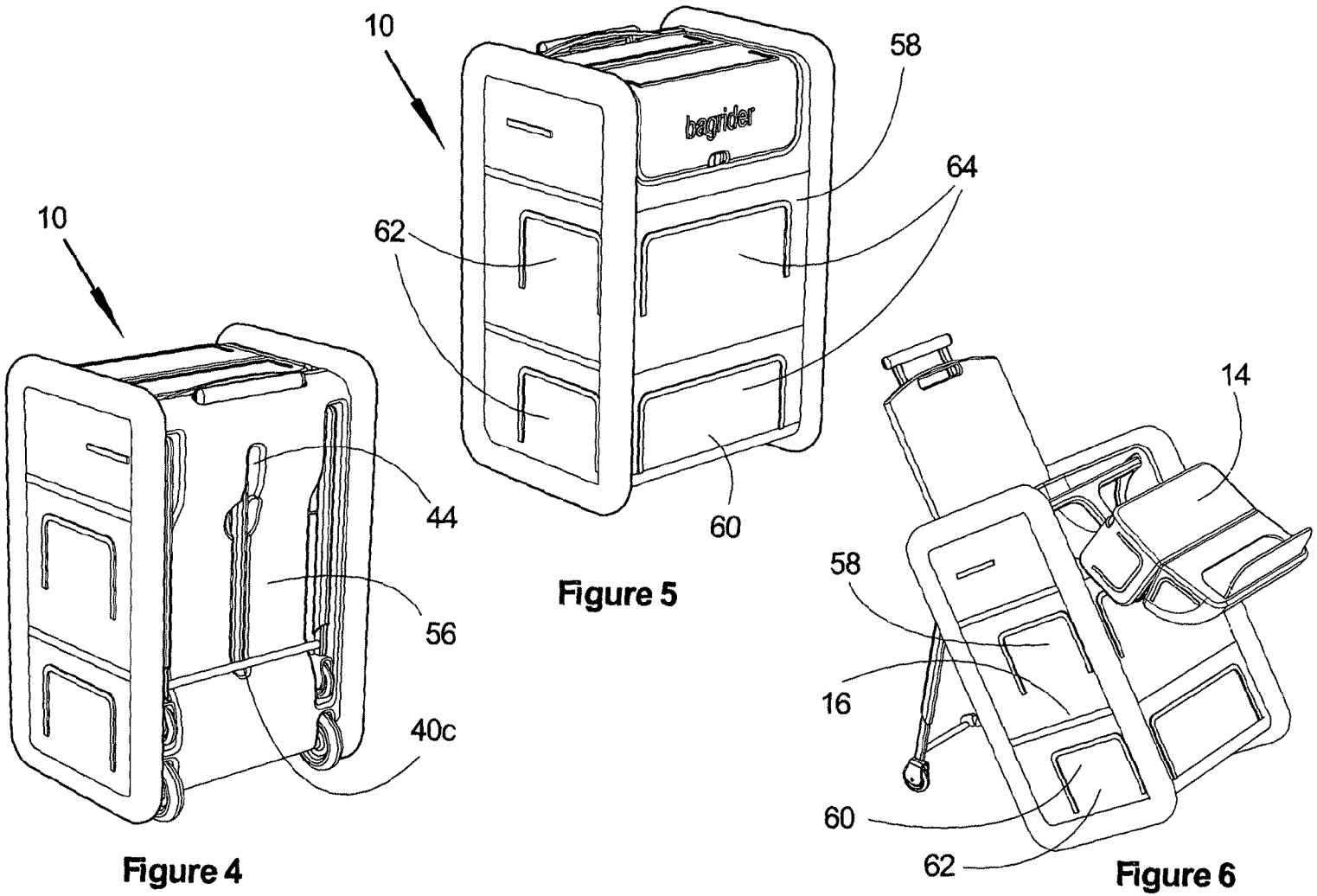
FIG. 4 is a rear perspective view of the apparatus of FIG. 1 showing the steerable wheels in a stored position.
FIG. 5 is a front perspective view of the apparatus of FIG. 1 in the stowed position.
FIG. 6 is a front perspective view of part of the apparatus of FIG. 1 in the deployed position.

Further features of the luggage apparatus 10 are visible from FIGS. 4, 5 and 6. FIG. 4 shows the back surface 44 of the apparatus 10 and, particularly, shows the deployable wheels 40*c* in a stored position in which they sit in a recess 56 defined by the apparatus back surface 44.

FIG. 5 shows the front and side of the apparatus and particularly shows the fixed portion 16 has first and second storage compartments 58, 60. Each of these storage compartments 58, 60 have a side access 62 and a front access 64 facilitating quick and easy access to the storage compartments 58, 60. The side access is 62 is of greatest benefit when the movable portion 14 is in the deployed position (shown in FIG. 6) in which accessing the storage compartments 58, 60 from the front may be restricted by the movable portion 14.

Various modifications and improvements may be made to the above described embodiment without departing from the scope of the invention. The sentence for example, harness may be provided to provide additional security for the child using the pram.

The invention claimed is:

1. A wheeled, cabin-sized suitcase, the wheeled, cabin-sized suitcase comprising:

a suitcase body comprising:

a moveable portion comprising:

a first moveable portion section comprising a first moveable portion section first surface; and a second moveable portion section comprising a second moveable portion section first surface and a second moveable portion section second surface;

wherein the first moveable portion section is pivotably connected to the second moveable portion section via a hinge between the first moveable portion section first surface and the second moveable portion section first surface; and a fixed portion comprising a fixed portion first surface;

wherein the moveable portion is pivotably connected to the fixed portion via a hinge between the second moveable portion section second surface and the fixed portion first surface;

wherein the moveable portion is movable with respect to the fixed portion between a deployed position and a stowed position;

wherein in the stowed position, the first moveable portion section first surface rests against the second moveable portion section first surface, the second moveable portion section second surface rests against the fixed portion first surface, and the first moveable portion section first surface, the second moveable portion section first surface and the second moveable portion section second surface are substantially contained within the apparatus body; and wherein in the deployed position, the fixed portion first surface and the second moveable portion section second surface are aligned substantially in parallel to define an extended seat for supporting a child's bottom and the first moveable portion section first surface and the second moveable portion section first surface are aligned substantially in parallel to define a leg rest.

2. The wheeled, cabin-sized suitcase according to claim 1, wherein the first moveable portion section comprises a support member adapted to support, in the deployed position, a child's feet.

3. The wheeled, cabin-sized suitcase according to claim 2, wherein the support member is a foot rest.

4. The wheeled, cabin-sized suitcase according to claim 2, wherein the support member is pivotally mounted to the first moveable portion section.

* * * * *